United States Patent [19]

Hermans et al.

[11] 3,984,583

[45] Oct. 5, 1976

[54] ELECTRON BEAM RECORDING METHOD

[75] Inventors: Theofiel Eveline Hermans, Boechout; Gerard Albert Delzenne, 's-Gravenwezel, both of Belgium

[73] Assignee: AGFA-GAEVAERT N.V., Mortsel, Belgium

[22] Filed: Oct. 22, 1974

[21] Appl. No.: 516,957

Related U.S. Application Data

[62] Division of Ser. No. 335,671, Feb. 26, 1973, Pat. No. 3,867,192.

[30] Foreign Application Priority Data

Feb. 29, 1972 United Kingdom ..... 9398/72

[52] U.S. Cl. ..... 427/43; 346/1; 346/135; 428/913

[51] Int. Cl.[2] ..... B05D 3/06

[58] Field of Search ..... 427/43; 428/913; 346/1, 346/135, 74 CR

[56] References Cited

UNITED STATES PATENTS

| | | | |
|---|---|---|---|
| 3,331,076 | 7/1967 | Dubbe et al. | 346/1 |
| 3,331,077 | 7/1967 | Plank | 346/1 |

*Primary Examiner*—John H. Newsome
*Attorney, Agent, or Firm*—William J. Daniel

[57] ABSTRACT

An electron beam-sensitive recording material that has a sensitivity to ultra-violet radiation not high enough to provide an optical density in the visible spectrum range of more than 0.2 when exposed with said radiation under the described test conditions, wherein said material comprises:

A. at least one dye precursor compound, which is capable of forming a dye when being in working relationship with an electron beam-exposed compound of the group mentioned here under (B), and B. a halogen-containing polymer undergoing dehydro-halogenation on electron beam impact and/or an organic compound containing one or two halogen atoms linked to a same carbon atom that is further linked to at least one electron-withdrawing group, and/or an organic compound that contains at least one non-halogen carrying carbon atom bound to at least one hydrogen atom and at least two electron-withdrawing groups, and/or a polyhalogenated aromatic hydroxy compound.

10 Claims, 1 Drawing Figure

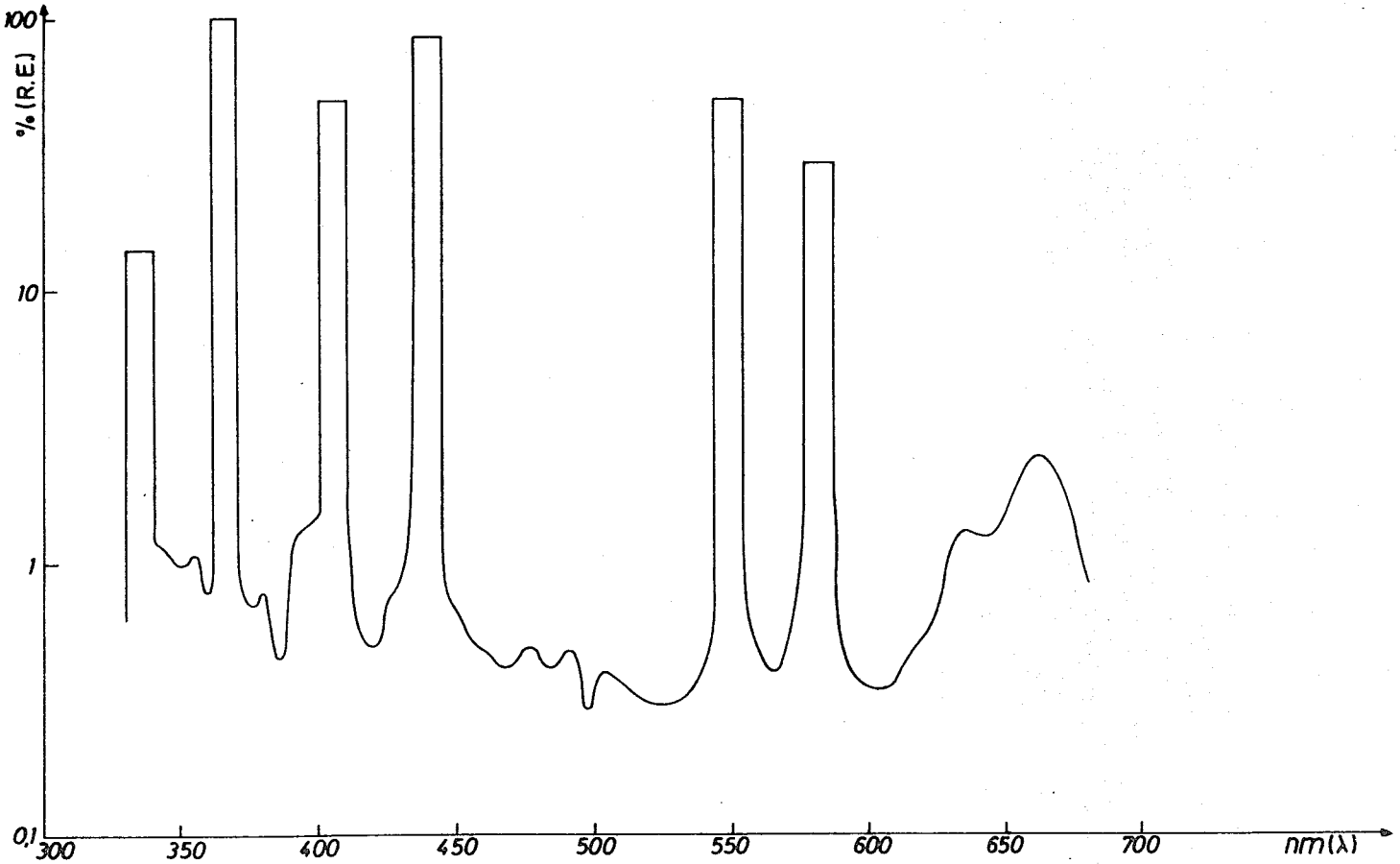
100
10
1
0.1
% (R.E)
300
350
400
450
500
550
600
650
700
nm (λ)

ELECTRON BEAM RECORDING METHOD

This is a division of Ser. No. 335,671, filed February 26, 1973, now Patent No. 3,867,192.

The present invention relates to recording media suited for the recording of information in the form of a modulated electron beam.

Electron sensitive layers wherein following exposure to electron beam radiation a visible colour change can be developed, are known already, e.g. from the U.S. Pat. Nos. 3,331,076 and 3,370,981.

In accordance with the invention described in the latter Specification a recording medium is used, which comprises a substrate, preferably an electrically conductive substrate, on which is super-imposed a layer containing an oil-soluble amino azo indicator dye in basic form and a highly halogenated polymeric binder.

Highly halogenated polymers are preferred as electron beam sensitive substances for they act as a relatively non-volatile source of hydrochloric acid when struck by high energy electrons and do not liberate such acid under visible light conditions.

A disadvantage associated with said recording medium is in the fact that the amino azo indicator dyes are inherently coloured, which makes them unsuited for producing images with a colourless image background.

It is an object of this invention to provide an electron beam-recording medium by means of which a visible record corresponding with the information supplied by an information-wise modulated electron beam can be obtained.

It is a preferred object of this invention to provide an electron beam-recording medium, which can provide visible images on a colourless or practically almost colourless image background.

It is further object of this invention to provide an electron beam-recording medium, which practically does not induce colour formation under ultra-violet radiation and visible light exposure conditions.

A still further object of the present invention is to provide a process for producing a visible record or image by means of a modulated electron beam.

Other objects and advantages will become apparent from the following description.

According to the present invention an electron beam-sensitive recording material is provided that has a practically negligible sensitivity to ultra-violet radiation and visible light, said material comprising:

A. at least one dye precursor compound, which is capable of forming a dye when being in working relationship with an electron beam-exposed compound of the group cited under (B), and B. a halogen-containing polymer undergoing dehydrohalogenation on electron beam impact, and/or an organic compound containing one or two halogen atoms linked to a same carbon atom, which is further linked to at least one electron-withdrawing group, and/or an organic compound that contains at least one non-halogen-carrying carbon atom bound to at least one hydrogen atom and at least two electron-withdrawing groups, and/or a polyhalogenated aromatic hydroxy compound.

Examples of suitable electron-withdrawing groups are: $>C=O$, $>SO_2$, $-C\equiv N$, $-NO_2$, $-N_3$, monovalent aromatic group, e.g., a phenly group and a -O-CO-R group in which R is an organic group, e.g. an alkyl group, an aryl group or a heterocyclic group. A suitable polyhalogenated aromatic hydroxy compound is e.g. 4,4'-dihydroxy-3,3',5,5'-tetrabromo-diphenyl-2,2-propane.

In order to assist in the selection of electron beam-sensitive compositions that contain a compound (A) effective contact with a compound (B) and that have an almost negligible sensitivity to U.V. radiation and visible light a standard test procedure has been developed, as follows:

In said test a selected spiropyran compound, for instance a compound having the following structural formula:

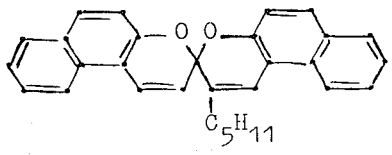

as representative of the compounds mentioned under (A) is coated in admixture with a selected compound of group (B) from a methylene chloride solution of polystyrene to a polyethylene terephthalate resin support.

The coating mixture contains the compounds (A) and (B) in a 1:2 molar ratio. The coating is effected in such a way that 0.25g of compound (A) are present per sq.m.

The applied coating is dried and exposed for 10 h at 20°C at a distance of 15 cm with a HPL-80 W mercury vapour lamp of N.V. Philips Gloeilampenfabrieken, Eindhoven, the Netherlands.

The emission spectrum of the radiation emitted by that lamp, % relative emission (R.E.) versus wavelength ( $\lambda$ ) in nm, in the range of 330 to 680 nm is represented in the accompanying drawing.

The emitted photon energy of that lamp at a distance of 15 cm from the centre of the lamp is approximately $10^5$ erg per sq.cm.

When the thus exposed recording medium does not show in the visible light range (400 nm –700 nm) a spectral density increase of more than 0.2 it is particularly useful when it possesses a sufficient sensitivity to be visibly changed by electron beam impact.

Recording materials having an already very useful electron beam-sensitivity are capable of yielding a visible mark with an optical density of at least 0.5 when struck by an electron beam that is accelerated with a potential difference of 20 kV and strikes the recording layer with a charge of $1.10^{-4}$ Coulomb per sq.cm.

Preferred colourless dye precursor compounds for use according to the present invention are spiropyran compounds containing at least one pyran ring having in the ortho- and meta-position to the oxygen atom an adjacent benzo, or naphtho ring or other higher aromatic polycyclic condensed ring system including these condensed rings or ring systems in substituted form, e.g. an anthraceno or a phenanthreno ring system as is present e.g. in a spirodibenzopyran, a spirodinaphtopyran, a spirobenzonaphthopyran, a 1,3,3-trimethylindolinobenzospiropyran, a 1,3,3-trimethylindolinonaphthospiropyran or such spiropyrans containing condensed aromatic nuclei of the anthracene or phenanthrene type.

In said spiropyrans the pyran rings, the condensed benzo rings, the condensed higher aromatic rings as well as the 1,3,3-trimethylindolino ring may be substituted.

Suitable substituents therefor are, e.g., hydrocarbon groups such as alkyl groups, e.g. lower alkyl groups such as methyl, substituted alkyl groups e.g. halogen or phenyl-substituted alkyl groups, alkylene ester groups e.g. a $-CH_2-COOC_2H_5$ group, alkylene carboxyl groups e.g. a $-CH_2-COOH$ group, alkylene carbonamide groups such groups in which the carbonamide group is substituted e.g. a

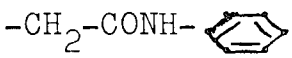

group, an acyl group, e.g. acetyl, halogen, nitro, hydroxy, alkoxy, aryloxy or a substituent linking the carbon atoms in 3,3'-position in the spiropyran system together e.g. a $(CH_2)_n$-chain wherein n is 2 or 3.

General formulae covering particularly suited spiropyrans are the following:

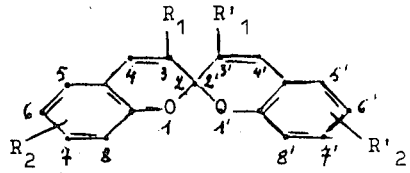

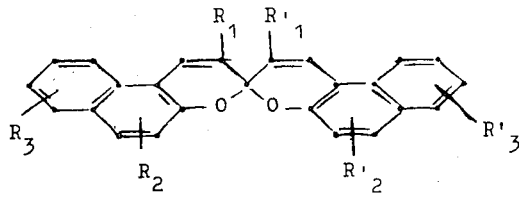

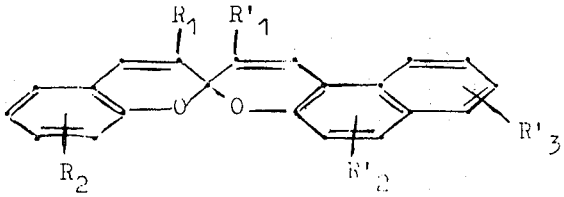

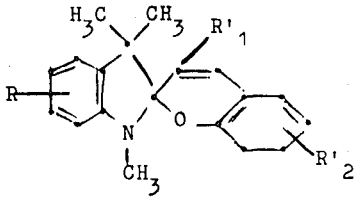

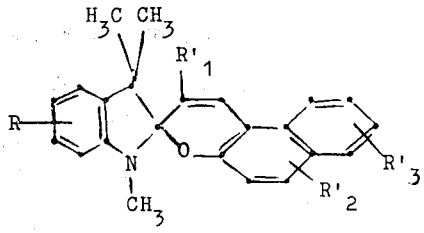

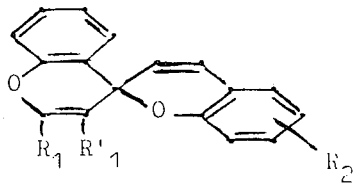

wherein: each of R, $R_1$, $R'_1$, $R_2$, $R'_2$, $R_3$ and $R'_3$ represents hydrogen, an aliphatic group including a substituted aliphatic group e.g. a $(C_1-C_{20})$ alkyl group including such an alkyl group in substituted form, more particularly a methyl, ethyl, propyl, amyl or hexadecyl group or halogenated alkyl group, an acyl group e.g. acetyl, halogen, nitro, hydroxy, an alkoxy or aryloxy group, a phenyl group or a substituted phenyl group, piperidyl, an alkylene ester group e.g. a $-CH_2-COOH_2H_5$ group, an alkylene carboxyl group e.g. a $-CH_2-COOH$ group, an alkylene carbonamide group or such a group in which the carbonamide group is substituted e.g. a

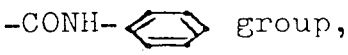

or $RR_1$ and $R'_1$ together represent a $-(CH_2)_n$-wherein $n = 2$, or 3 to link the carbon atoms in the 3 and 3' positions together.

Suited spiropyran compounds and their preparation are described in the published German Patent Applications 1,274,655 - 1,269,655 - 1,286,110 - 1,286,111 and 1,286,112, and by W. Dilthey, Berres, Holterkoff, Wubken, J. Prakt. Chem. [2] 114, 187 (1926), by C. F. Koelsch and W. R. Workman in J.Am.Chem.Soc. 74, 6288 (1952) and by I. M. Heilbron and G. F. Howard in J.Chem.Soc. (1934), 1571.

Preferred spiropyran compounds are spirodinaphthopyrans and spirobenzonaphthopyrans including such compounds wherein the naphtho- and/or benzo ring(s) is (are) substituted.

An illustrative list of particularly useful spiropyran compounds is given in the following Table 1.

TABLE 1

| | Spiropyran compound | Melting point (°C) |
|---|---|---|
| 1. | 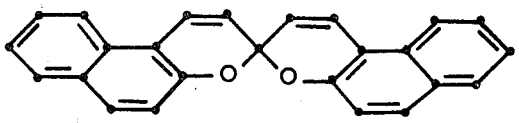 | 257 |

Table 1—Continued
| Spiropyran compound | Melting point (°C) |
|---|---|
| 2. 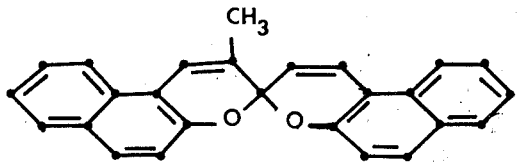 | 204 |
| 3. 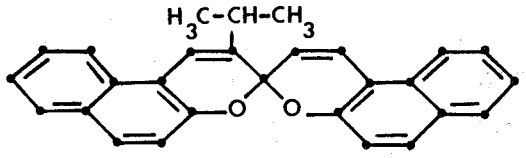 | 208 |
| 4. 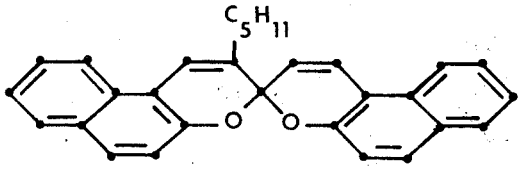 | 185 |
| 5. 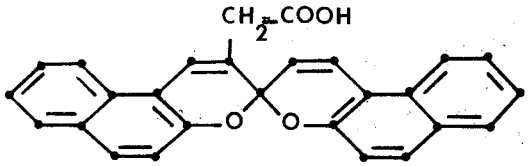 | 164 |
| 6. 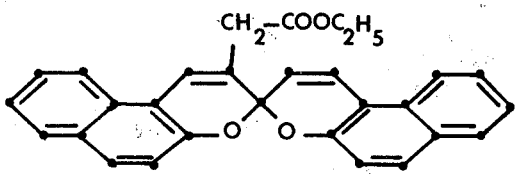 | 166 |
| 7. 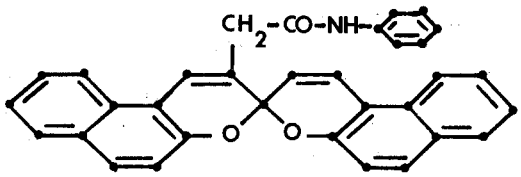 | 210 |
| 8. 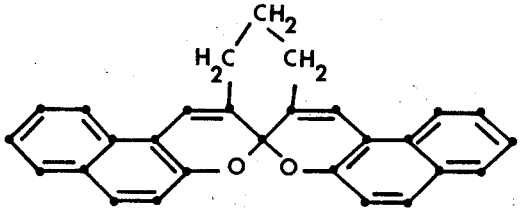 | 238 |
| 9. 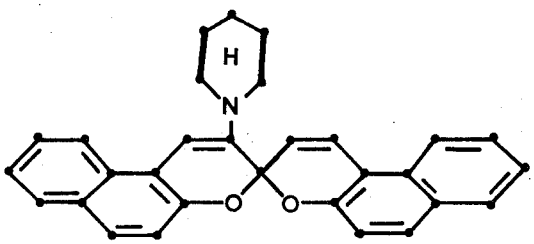 | 140 |

Table 1—Continued
| Spiropyran compound | Melting point (°C) |
|---|---|
| 10. 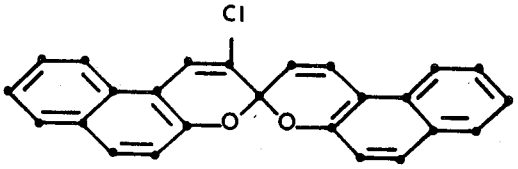 | 180 |
| 11. 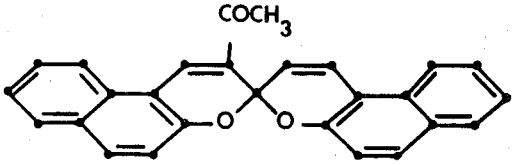 | 260 |
| 12. 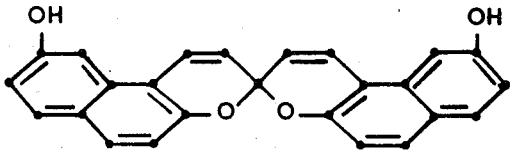 | > 260 |
| 13. 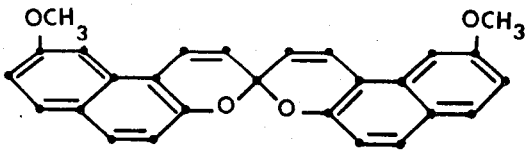 | > 260 |
| 14. 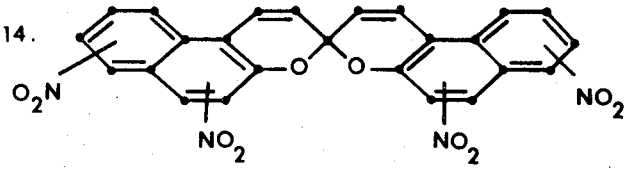 | > 260 |
| 15. 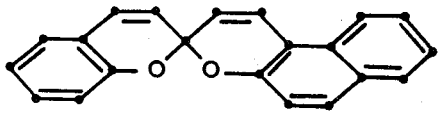 | 168 |
| 16. 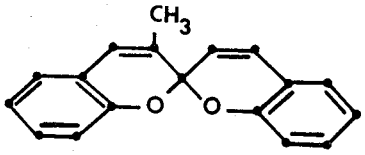 | 110 |
| 17. 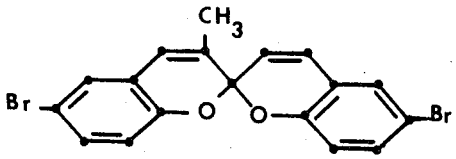 | 163 |
| 18. 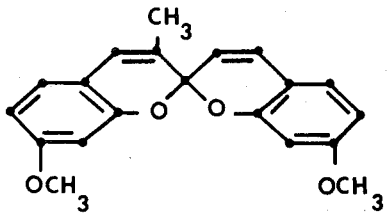 | 110 |

Table 1—Continued
| Spiropyran compound | Melting point (°C) |
|---|---|
| 19. 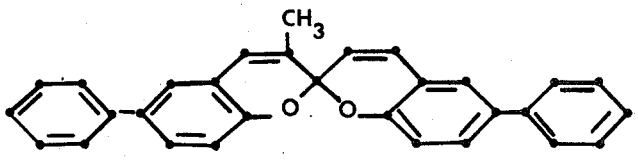 | 185 |
| 20. 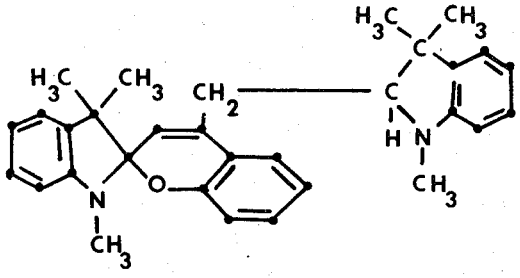 | 206 |
| 21. 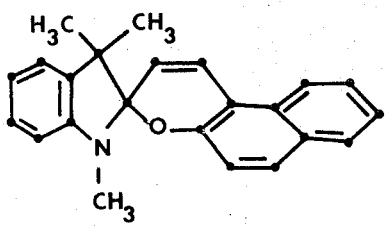 | 180 |
| 22. 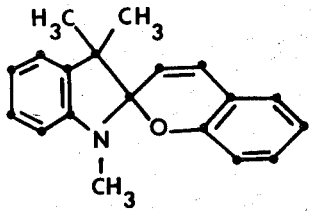 | 88 |
| 23. 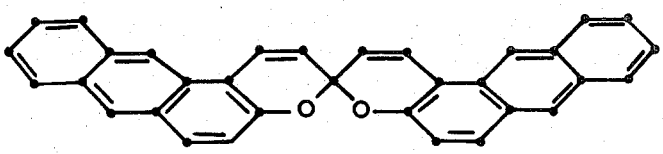 | > 260 |
| 24. 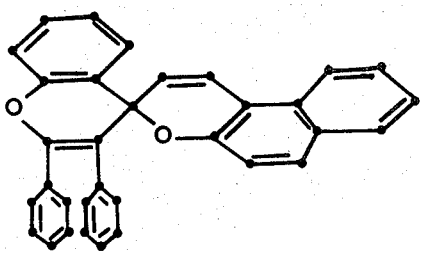 | 173 |

Table 1—Continued
| Spiropyran compound | Melting point (°C) |
|---|---|
| 25. 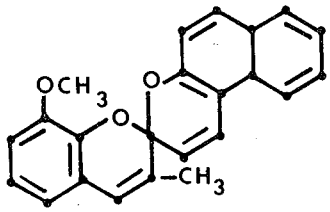 | 193 |
| 26. 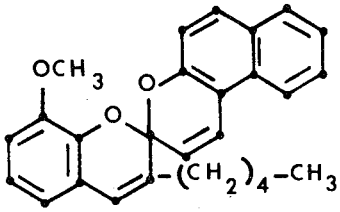 | 158 |
| 27. 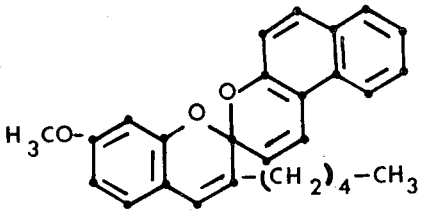 | 144 |
| 28. 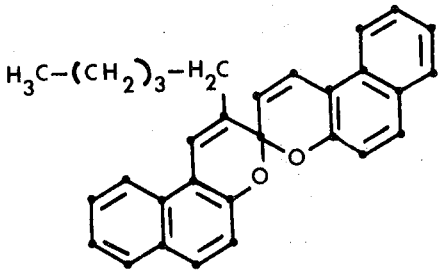 | 180 |
| 29. 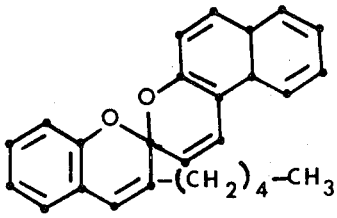 | 160 |

Table 1—Continued
| | Spiropyran compound | Melting point (°C) |
|---|---|---|
| 30. | 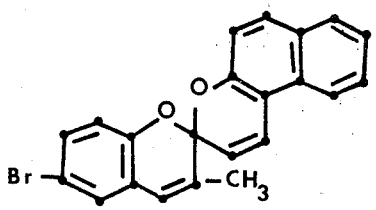 | 112 |
| 31. | 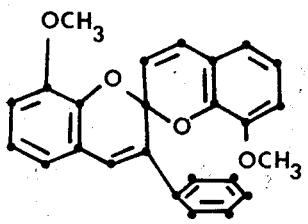 | 120 |
| 32. | 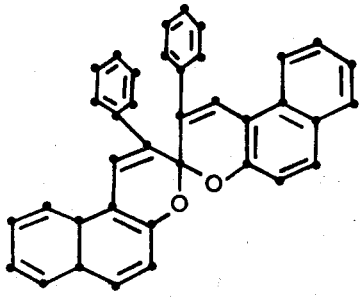 | ± 200 |
| 33. | 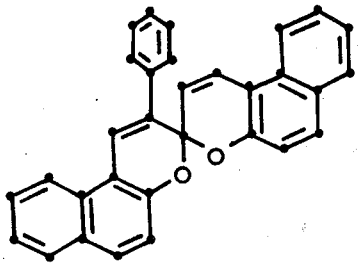 | 248 |
| 34. | 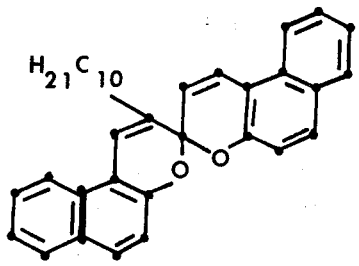 | 152 |

Table 1—Continued
| Spiropyran compound | Melting point (°C) |
|---|---|
| 35. 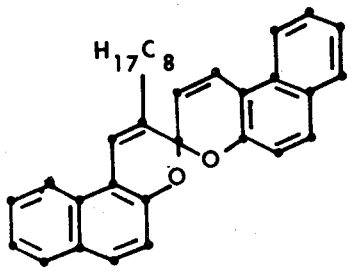 | 160 |
| 36. 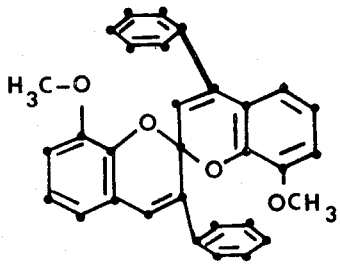 | ± 250 |
| 37. 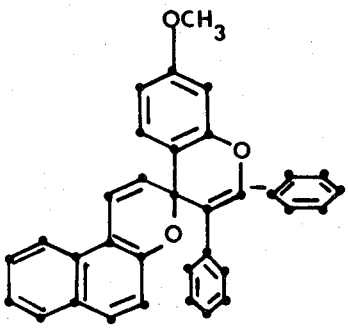 | 173 |
| 38. 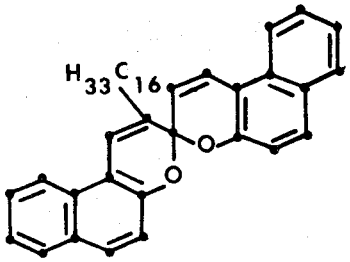 | 133 |

Table 1—Continued

| Spiropyran compound | Melting point (°C) |
|---|---|
| 39. 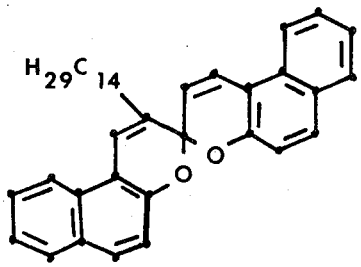 | 146 |

In order to illustrate in more details the preparation of the spirobi( arylopyran) compounds and of the spiro (indolino, arylopyran) compounds the following preparation recipes are given:

PREPARATION 1

Preparation of 3-methyldi-β-naphthospiropyran (compound 2 of Table 1)

In a three-necked 2 litre flask, fitted with a reflux condenser and a gas inlet tube reaching nearly the bottom of the flask are introduced:

| | |
|---|---|
| ethanol | 1 liter |
| butanone | 22 ml (0.25 mole) |
| 2-hydroxy-1-naphtaldehyde | 86 g (0.5 mole) |

The flask is shaken until partial dissolution of the ingredients. Dry hydrogen chloride gas is introduced at a rate that allows complete absorption and the start of ethanol reflux. Thereupon the already strongly blue coloured mixture is cooled in a mixture of ice and sodium chloride and the introduction of hydrogen cloride gas is continued until saturation. In the reaction mixture green crystals of pyrylium salt form and the cyrstallization is allowed to proceed overnight in a refrigerator.

The pyrylium salt formed is separate by suction, washed with ethanol and thereupon brought into suspension in 300 ml of ethanol.

Whilst stirring a 10 % by weight aqueous solution of ammonium hydroxide is added until the mixture is definitely alcaline. During that operation the mixture becomes colourless.

The crystalline product obtained in separated by suction, washed with water and dried.

Finally the spiropyran compound is recrystallized from 600 ml of benzene and again separated and dried under reduced pressure at 50°–60°C.

Yield : 45 g. Melting point: 204°C.

PREPARATION 2

Preparation of 1,3,3-trimethylindolinobenzopyrylospiran (compound 22 of Table 1)

In a 100 ml flask fitted with a reflux condenser are introduced the following ingredients:

| | |
|---|---|
| salicylaldehyde | 3.7 g (0.03 mole) |
| 1,3,3-trimethyl-2-methylene indolamine | 5.1 g (0.03 mole) |
| ethanol | 90 ml |

The solution is boiled under reflux for 2 hours. Thereupon the mixture is cooled and filtered.

To the filtrate water is added for separation of a solid product. The solid is separated by suction, washed with water and dried under vacuum conditions.

The spiran compound is recrystallized from 15 ml of hexane.

Yield : 5 g. Melting point: 93°–94°C.

It is assumed that by the electron beam exposure a dyestuff salt having the pyrylium structure forms when a spirobi(arylopyran) compound is used as as dye precursor, and that when a spiro(indolino, arylopyran) compound is used, a dyestuff having the indolinium salt structure forms.

Other preferred colourless dye precursor compounds for use according to the present invention correspond to one of the following general formulae (I) or (II) :

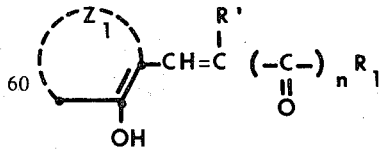

(I)

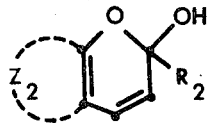

232

(II)

wherein:

$R_1$ represents an organic group, e.g. a saturated or unsaturated aliphatic group e.g. an alkyl group including a substituted alkyl group or an aryl group including a substituted aryl group, or represents together with R′ the necessary atoms to close a homocyclic ring, e.g. a cyclohexylen-2-one ring, R′ represents hydrogen, a lower alkyl group e.g. methyl, a substituted lower alkyl group e.g. benzyl, a phenyl group including a substituted phenyl group, or phenyloxy, $Z_1$ represents the necessary atoms to close a homocyclic ring or ring system including such a ring or ring system in substituted state e.g. a phenyl group, a naphthyl group or such groups carrying in addition to the hydroxyl group one or more substituents e.g. a methoxy group or a benzyl group that is further sutstituted with hydroxy group, and a $-CH=CH-COR_1$ group, $R_1$ having the significance as defined above, $Z_2$ represents the necessary atoms to close a homocyclic nucleus including a substituted homocyclic mucleus, e.g. a benzene or a naphthalene nucleus including a substituted benzene or naphthalene nucleus, $R_2$ represents a lower alkyl ($C_1$–$C_5$) group, and $n$ is 1 or 2.

The following Table 2 contains an illustrative list of compounds according to the above general formula (I) with their melting point.

Table 2

| Number of the compound | Stuctural formula | Melting point °C |
|---|---|---|
| 1 | 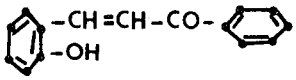 | 155 |
| 2 | 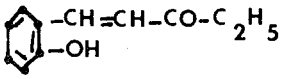 | 105 |
| 3 | 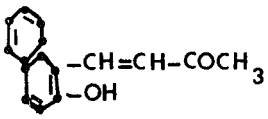 | 130 |
| 4 | 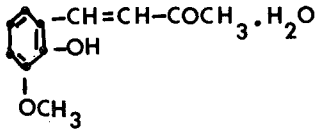 | 83 |
| 5 | 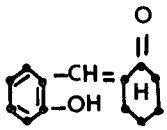 | 148 |
| 6 | 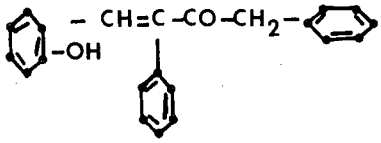 | 177 |
| 7 | 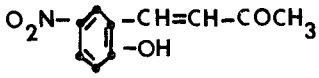 | 227 |
| 8 | 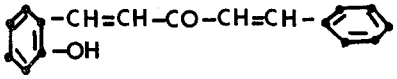 | 139 |

Table 2—Continued
| Number of the compound | Stuctural formula | Melting point °C |
|---|---|---|
| 9 | 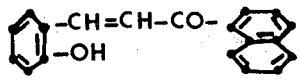 | 127 |
| 10 | 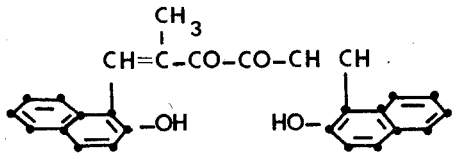 | > 200 |
| 11 | 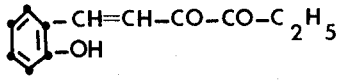 | 160 |
| 12 | 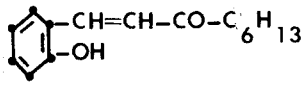 | 74 |
| 13 | 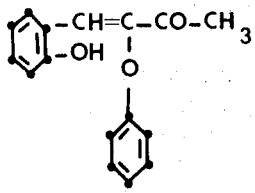 | 153 |
| 14 | 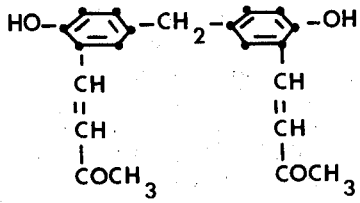 | > 200 |
| 15 | 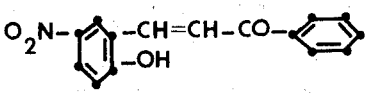 | 250 |
| 16 | 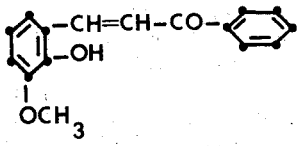 | 115 |
| 17 | 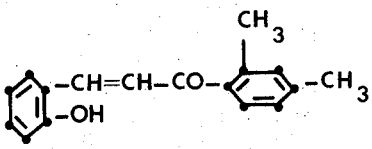 | 115 |
| 18 | 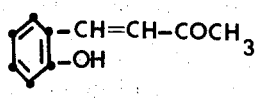 | 139 |

Table 2—Continued

| Number of the compound | Stuctural formula | Melting point °C |
|---|---|---|
| 19 | 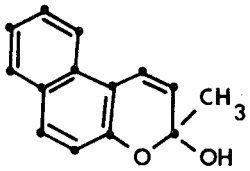 | 200 |
| 20 homopolymer containing recurring units of the following formula : | 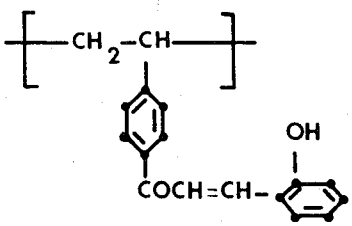 | |

The compounds of general formula (I) may be prepared e.g. according to:

Heilbron and Whitworth, J. Chem. Soc. 123, 243 (1923).

C. D. Harries, Ber. 24, 3180 (1891).

Decker & V. Fellenberg, Ann. 364, 21 (1909).

A suitable compound according to the general formula (II) has the following structure:

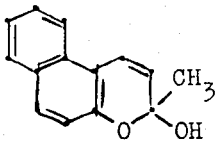

the preparation of which may proceed as follows:

In a 250 ml flask fitted with a reflux condenser and a gas inlet tube reaching nearly the bottom of the flask are introduced:

| | |
|---|---|
| 2-hydroxy-1-naphthaldehyde | 10 g |
| acetone | 50 ml |

The flask is shaken until a solution is obtained and subsequently while the flask is cooled in ice water dry hydrogen chloride gas is introduced for 15 min.

Thereupon the reaction mixture is kept at room temperature for 24 h. The dark green solution obtained is poured into 200 ml of water. A sticky green product separates. The supernatant water layer is removed and the residue treated with 50 ml of methanol so that the residue solidifies. The solid obtained is pulverised and washed again with 50 ml of methanol.

Yield after drying: 9 g., Melting point: 200°C.

Compound 20 of Table 2 has been prepared as described in the Belgian Patent Specification 787,339.

A first preferred class of electron beam-sensitive compounds (B) are highly halogenated polymers that liberate hydrogen halide upon electron bombardment. When these polymers are solid they may serve as binder for the dye precursor compound(s). The molecular weight is therefore preferably above 1000 and more preferably above 10,000.

Preferred polymers contain in addition to hydrogen at least 25 percent by weight of labile halogen selected from the group of chlorine and bromine.

For ease of coating the halogenated polymers are preferably soluble in fairly highly volatile organic solvents e.g. acetone, 2-butanone, methylethyl ketone and tetrahydrofuran. In the preparation of the halogenated polymers preferably monomers such as vinylidene chloride, and vinyl chloride, and ethylenically unsaturated monomers with a high halogen content such as 1,1,3,3,3-pentachloropropene-1-fluorotrichloroethylene, 1,1-difluoro-2,2-dichloroethylene and trichloroethylene are used.

These monomers may be copolymerized to some extent e.g. to improve the film-forming characteristics or the solubility in the solvent or solvent mixture applied in the coating operation. Suitable comonomers are e.g. methyl acrylate, ethyl acrylate, n-butyl acrylate, hexyl acrylate, methyl methacrylate, and β-chloroethyl acrylate.

Preferred natural polymers modified by halogenation are halogenated rubbers.

Preferred vinylidene chloride polymers have a chlorine content ranging from about 25 to about 73 percent by weight. With the vinyl chloride polymers the chlorine concentration ranges preferably from about 20 to 55 percent, more preferably from about 35 to about 55 percent by weight of the polymer. A second preferred class of electron beam-sensitive compounds (B) that are capable of producing reactive substances suitable for acid formation comprises organic compounds containing one or two halogen atoms e.g. chlorine, bromine or iodine linked to a same carbon atom that is further linked to at least one electron-withdrawing group e.g. >C=O, $>SO_2$, -C ≡ N, $-NO_2$, $-N_3$ or phenyl group.

Compounds falling within the scope of that class and that behave as desired in the described test are e.g. the compounds listed in Table 3.

Table 3

| Structural formula | Melting point (°C) |
|---|---|
| 1. 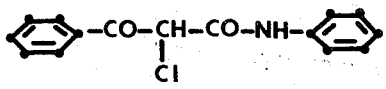 | 123 |
| 2. 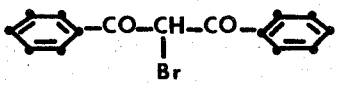 | 93 |
| 3. 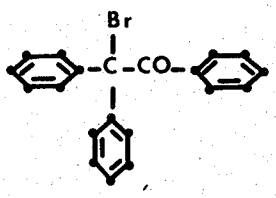 | 98 |

In order to illustrate the preparation of the compounds of Table 3 the preparation of compound 1 is given in detail hereinafter.

478 g of benzoylacetoanilide are whilst stirring dissolved in 3 litres of methylene chloride and the solution boiled with reflux. At reflux temperature over a period of 45 min. 270 g of sulphonyl chloride are added dropwise. The reaction proceeds exothermally so that no further heating is required.

After the addition of the sulphonyl chloride the stirring is maintained for 4 hours. Thereupon 50 ml of methanol are added and heating for maintaining the reflux is started again. Residual unreacted sulphonyl chloride is driven off. After standing overnight the solvent of the reaction mixture is evaporated and a solid white product is obtained. The thus obtained product is recrystallized from a mixture of 800 ml of ethanol and 250 ml of water.

Yield: 86%., Melting point: 123°C.

A third preferred class of electron beam-sensitive compounds (B) that are capable of producing reactive substances suitable for acid formation comprises organic compounds that contain at least one non-halogen-carrying carbon atom bound to at least one hydrogen atom and at least two electron-withdrawing groups of which the groups >C=O, $>SO_2$, -C ≡ N, $-N_3$, and -O-CO-R in which R is an organic group e.g. an alkyl, an alkenyl, an aryl or a heterocyclic group are representatives.

Compounds falling within the scope of that class and that behave as described in the above described test may be selected from compounds corresponding to the following general formula:

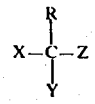

wherein:

each of X, Y and Z represents an acyl radical, e.g., a carboxylic acid or sulphonic acid acyl radical, a cyano group, a nitro group, an azido group, an ester group, a carbonyl alkoxy group, a carbamyl group including a substituted carbamyl group, a sulphamyl group including a substituted sulphamyl group, or wherein X and Y are joined together to form a nucleus containing two strong electron-withdrawing groups, each being attached to the carbon atom having the Z substituent, R represents hydrogen, $-N_3$, an alkyl radical including a substituted alkyl radical, an aryl radical including a substituted aryl radical, or a heterocyclic radical including a substituted heterocyclic radical.

At least one of the X, Y and Z substituents in the above general formula preferably represents a $-CO-R_1$, $-SO_2R_1$, $$-CO-N\begin{matrix}R_1\\R_1\end{matrix},$$

-CN or $-NO_2$ group, wherein $R_1$ represents an alkyl radical including a substituted alkyl radical, an aryl radical including a substituted aryl radical or a heterocyclic radical including a substituted heterocyclic radical.

Specific examples of compounds of that third class suited for use according to the present invention are represented in the following Table 4.

In order to illustrate the preparation of the compounds of Table 4 the preparation of the compounds 1, 2, 3 and 4 is given hereinafter.

PREPARATION OF COMPOUND 1

Reaction scheme:

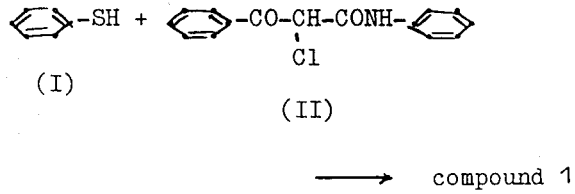

Table 4

| Structural Formula | Melting Point °C |
|---|---|
| 1. 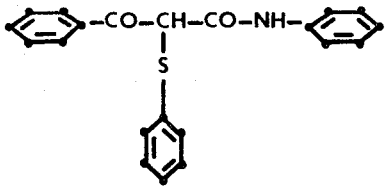 | 145 |
| 2. 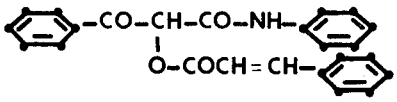 | 160 |
| 3. 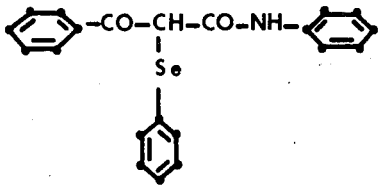 | 98 |
| 4. 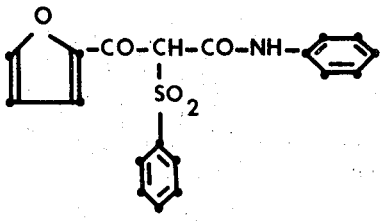 | 161 |
| 5. $CH_3-COO-\underset{\underset{COCH_3}{\vert}}{CH}-COOC_2H_5$ | Boiling point : 120-122°C / 15 mm Hg |

Table 4—Continued

| Structural Formula | Melting Point °C |
|---|---|
| 6. 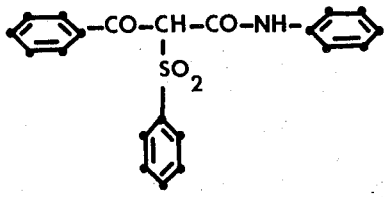 | 155 |
| 7. 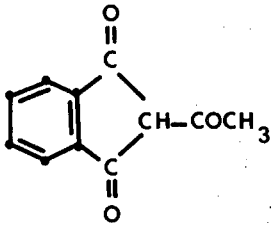 | 110 |
| 8. 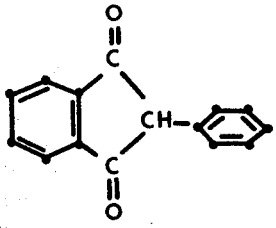 | 146 |

2.1 g of compound (I) and 5.47 g of compound (II) are boiled for 1 hour with reflux in 25 ml of ethanol. The reaction mixture is cooled slowly overnight and the precipitate formed sucked off and 3 times washed with methanol.

Yield: 2 g., Melting point: 145°C.

PREPARATION OF COMPOUND 2

Reaction scheme:

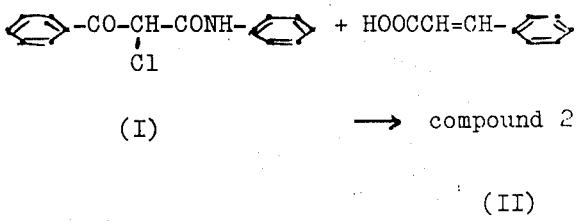

13.6 g of compound (I) are dissolved in 30 ml of dimethylformamide. To this solution 8 g of compound (II) and 6 g of diethylamine are added. The reaction mixture is boiled with reflux for 3 h whereupon the reaction mass is poured into water. The obtained crude product is purified with active carbon in boiling ethanol.

Yield: 8 g., Melting point: 160°C.

PREPARATION OF COMPOUND 3

Reaction scheme:

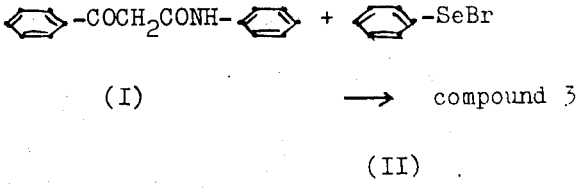

12 g of compound (I) are dissolved in 250 ml of chloroform. To the obtained solution 13.5 g of compound (II) dissolved in 100 ml of chloroform are added. The reaction mixture is boiled with reflux for 4 h and cooled overnight. The solvent is removed by evaporation. The crude product is recrystallized from benzene.

Yield: 4 g., Melting point: 98°C.

PREPARATION OF COMPOUND 4

Reaction scheme:

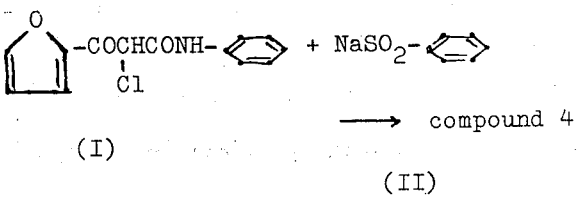

5.3 g of compound (I) and 6.5 g of compound (II) are mixed in 75 ml of dimethylformamide and heated for 4 hours on a water bath at 40°C. Thereupon the reaction mass is poured into 500 ml of a mixture of water and ice. The formed precipitate is washed with water and dried.

Yield: 6 g., Melting point: 161°C.

Compound 5 is prepared e.g. according to Ber. 56B, 1380.

Compound 6 is prepared e.g. by oxidation with hydrogen peroxide of compound 1 described above.

Compound 7 is prepared e.g. according to Ber. 47, 3334.

Compound 8 is prepared e.g. according to Ber. 47, 1439.

The recording medium may be formed as a supported layer or self-supporting film or sheet.

The recording media of this invention may be prepared by mixing the dye precursor compound with the electron-beam sensitive compound and applying that mixture to a suitable support or coating base.

Although the electron beam-sensitive coating is preferably deposited from a solution as a film on a support it may be applied as a dispersion having one of the components in dispersed state in a binder solution containing the other component in dissolved form or containing both the components intimately mixed as the dispersed phase.

According to a particular embodiment both the dye precursor compound and electron beam-sensitive substance are present in mixed form in solid grains or liquid droplets dispersed in a hydrophilic binder such as a hydrophilic colloid e.g. gelatin.

For each mole of dye precursor compound preferably at least 1 to about 1000 acid equivalents of the electron beam-sensitive compound are used.

In addition to the mixture of dye precursor compound, electron beam-sensitive substance and binding agent the recording element composition may contain other ingredients e.g. substances that act as fog inhibitor and substances that improve the electron beam-sensitivity and increase the optical density.

Substances that improve the electron beam-sensitivity may be found in the classes of sensitizing agents described in the Belgian Patent Specification 771,848. Examples of such compounds are: Michler's ketone and styryl dyes.

Other additives improve e.g. the mechanical strength or control the coating viscosity, elasticity or gloss of the recording element.

In connection with the inhibition of spontaneous fog are to be mentioned particularly anti-foggants such as triaryl compounds of group V elements e.g. triphenylstibine and sterically hindered phenols e.g. 2,6-di-tert. butyl-p-cresol and other reducing agents or compounds accepting atmospheric oxygen.

Triphenylstibine and analogous compounds for the purpose of fog inhibition in a photoradical recording system based on dye salt formation are described in the United Kingdom Patent Specification 1,071,104.

When the recording composition for producing a supported layer is coated, that layer preferably is 1 $\mu$m to 50 $\mu$m thick in dried state. The support, if any, is preferably electrically conductive or contains a subbing layer or interlayer with relatively high electrical conductivity.

Suitable supports are e.g. those used in electrophotographic materials.

Suitable electro-conductive plates or sheets serving as support have preferably an electrical resistivity at least 100 times as small as that of the recording layer. Supports whose surface resistance is not higher than $10^7$ ohm per sq. are preferred.

Examples of suitable supports are conductive plates, e.g. plates of metals such as aluminium, zinc, copper, tin, iron, or lead.

Too highly insulating supports can be provided with a conductive subbing layer or interlayer.

Suitable electro-conductive interlayers for insulating supports are, e.g., vacuum-coated metal and conductive metal compound (metal oxide or metal salt) layers such as silver, tin, aluminium, titanium dioxide and copper iodide conductive layers, transparent conductive polymer layers, e.g. applied from polymers containing quaternized nitrogen atoms, such as those described in the United Kingdom Patent Specification 950,960, or layers containing conductive particles, e.g. carbon black and metal particles dispersed in a binder. The binder used for said particles has a resistivity preferably lower than $10^6$ ohm.cm. A suitable binder for that purpose is gelatin.

Transparent electron beam-recording materials are produced by applying the dye-forming compounds together with a suitable binder (if necessary) from a clear solution to a conductive transparent base or a transparent insulating base coated with an electroconductive transparent interlayer.

As transparent bases resin sheets having an optical density of not more than 0.10 are preferred, e.g., a sheet made of polyethylene terephthalate or cellulose triacetate. The conductive interlayer preferably consists of a metal coating, e.g., a vacuum-coated aluminium layer having an optical density of not more than 0.30 or of a conductive transparent polymer layer containing an organic polyionic polymer, e.g. a polymer containing quaternized nitrogen atoms such as a quaternized polyethyleneimine.

In reproduction techniques wherein the prints are to be produced on an opaque or semi-transparent background preferably a paper sheet is used as support for the recording layer.

Paper sheets that have an insufficient electrical conductivity are coated or impregnated with substances enhancing their conductivity, e.g. by means of a conductive overcoat such as a metal sheet laminated thereto.

As substances suited for enhancing the conductivity of a paper sheet and which can be applied in the paper mass are particularly mentioned hygroscopic compounds and antistatic agents as described, e.g., in the United Kingdom Patent Specification 964,877, and antistatic agents of polyionic type, e.g. CALGON CONDUCTIVE POLYMER 261 of Calgon Corporation, Inc., Pittsburgh, Pa., U.S.A., provided as a solution containing 39.1% by weight of active conductive solids, on the basis of a conductive polymer having recurring units of the following type:

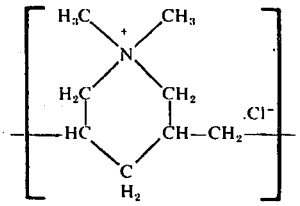

The applied paper sheets are preferably impermeabilized to organic solvents, e.g. by means of a water-soluble colloid or by strongly hydrating the cellulose fibers such as in glassine paper.

In a preferred recording layer composition of the present invention halogen-containing electron beam-sensitive polymers are used that serve as binding agent for the dye precursor compound. Such a layer contains preferably from 0.01 to 0.1% by weight of dye precursor compound. The amount of dye precursor compound per sq.m is preferably in the range of 0.2 g to 2 g per sq.m.

When applying low molecular weight (< 1000) or monomeric compounds that are electron-beam-sensitive, a binding agent is used to form a sufficiently strong layer or sheet embedding these compounds in working relationship with the dye precursor compound(s).

According to a preferred embodiment said low molecular weight or monomeric compounds are used in excess with respect to the dye precursor compounds e.g. in a 2:1 to 20:1 molar ratio.

Additional films or coatings may be provided on the electron beam-sensitive element to protect it from abrasion provided they are relatively transmissive to the electron beam.

If the electron-beam-sensitive layer is self-supporting it has not to contain a conductive backing layer when during the electron beam exposure it is held in electroconductive contact with an electrically conductive element e.g. a metal plate or roller that is grounded or kept at a different potential with respect to the electron beam.

Good electrical contact between the electron beam-sensitive layer and a conductive backing, normally maintained at ground potential is best achieved with an electrically conductive layer or support making integrally part of the recording medium that is e.g. manufactured in the form of a recording strip or tape.

With the media described above a colour change is generally observed in the sensitive element immediately upon electron beam impingement or shortly thereafter by overall heating the recording element (thermal development).

The temperature and duration of heating can vary. In general, lower heating temperatures require longer heating times, and vice versa, in order to develop or intensify an image pattern. Heating times and temperatures are dependent upon the degree of image intensification desired or necessary. Usually temperatures below 200°C and heating times no longer than 5 minutes are employed.

When records are made by the use of an intensity modulated scanning electron beam, it is usually convenient to operate in a vacuum chamber wherein a reduced pressure e.g. of the order of $10^{-4}$ to $10^{-9}$ mm Hg are maintained.

Although in the preceding description of the invention stress has been laid on the use of an electron beam in the recording of information on the present recording elements, these elements are equally well suited for the recording of other high energy particle beams e.g. proton beams, neutron beams (producing secondary electrons) and ion beams.

The intensity of these beams can be modulated by means well known to those skilled in the art. Since the generation and control of beams of high energy is accomplished by apparatus and methods which do not form a part of the present invention and which are well known to those of ordinary skill in the art, no detailed explanation thereof is given herein. The particular type of high energy beam employed in any given instance depends, of course, upon the sensitivity and response associated with the given recording medium and upon the recording conditions.

It is not absolutely necessary to use intensity modulated scanning beams since originals e.g. a punched tape or chart in forming a density pattern for the high intensity particle radiation can be flooded (simultaneously overall exposed) with said radiation.

The type of information stored can vary widely. For example sound track and video signals and facsimile signals can be recorded. The recording process of the present invention is not limited by the information to be stored. Information of various kind can be used as input for modulating an electrical signal which occasionally is obtained by means of one or more transducers.

The following examples illustrate further the present invention.

The percentages are by weight unless otherwise mentioned.

EXAMPLE 1

A solution was prepared having the following composition:

| | |
|---|---|
| spiropyran compound no. 4 of Table 1 | 20 mg |
| chlorinated natural rubber (PARLON-125 cps of Hercules Powder Company Inc., Wilmington, Del.) | 500 mg |
| methylene chloride | 10 ml |

The solution was knife-coated (wet coating thickness 0.127 mm) on a polyethylene terephthalate film support provided with a transparent conductive coating.

The transparent conductive coating was applied from an aqueous solution of gelatin and Calgon Conductive Polymer 261 in a weight ratio of 2:1. The conductive coating contained 2 g of gelatin per sq.m. The electrical resistance of the coating was $1 \times 10^6 \Omega$/sq.cm at a relative humidity of 50%.

The electron beam-sensitive coating containing the spiropyran compound was dried at 60°C for 2 h.

In order to check the sensitivity to ultra-violet radiation and to see whether or not a coloration resulted from a prolonged U.V. exposure a part of the dried recording material was subjected for 10 h to U.V. radiation of a HPL-80 W mercury vapour lamp placed at a distance of 15 cm.

No optical density increase higher than 0.2 was obtained in the visible spectrum.

Another part of the recording material was exposed in an electron probe analyser AMR/3 of Philips Electronic Instruments. The electron beam had an accelerating potential of 15 kV and a resulting target current of about 40 $\mu$A. The electron beam was focused till forming a circular cross-sectional diameter of about 1 $\mu$m in the target region. The beam scanned a 0.5 mm line in a period of 5 ms. The pressure maintained in the apparatus was below $10^{-3}$ mm Hg.

The scanned portions of the recording layer could be detected visually by inspection with an optical microscope and were seen as separate blue lines.

Analogous results were obtained by replacing chlorinated natural rubber by one of the following binding agents:

"OLOVIN F/M" of Wacker-Chemie, Munich, W. Germany, which binding agent has the following structural formula:

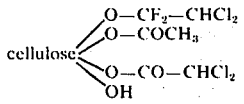

"HYPALON 30" of E. I. du Pont de Nemours and Co (Inc.), Wilmington, Del., U.S.A., a binding agent having the following structure:

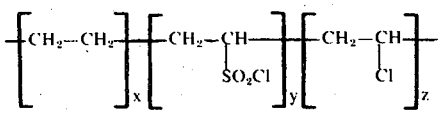

(x/y/z = 26.1/6.9/67 % by weight)

"GEON - 200 × 20" of British Geon Ltd. (a copolymer of vinyl chloride and vinylidene chloride) polyvinyl chloride.

EXAMPLE 2

Example 1 was repeated with the proviso, however, that as dye precursor compound 18 of Table 2 was used. magenta lines were obtained.

EXAMPLE 3

A solution was prepared having the following composition:

| | |
|---|---|
| the spiropyran compound number 1 of Table 1 | 20 mg |
| the electron beam-sensitive compound number 2 of Table 4 | 200 mg |
| methylene chloride | 5 ml |
| 10% solution in methylene chloride of polystyrene | 5 ml. |

The coating of said solution proceeded in the same way as described in Example 1 on the same support.

The exposure to ultra-violet radiation was effected as described in Example 1 and yielded an overall colouration with a maximum density not higher than 0.2.

The electron beam exposure likewise effected as described in Example 1 resulted in the print-out formation of bluish purple lines.

EXAMPLE 4

A solution was prepared having the following composition:

| | |
|---|---|
| spiropyran compound number 1 of Table 1 | 20 mg |
| electron beam-sensitive compound number 2 of Table 4 | 200 mg |
| methylene chloride | 5 ml |
| 10% solution in methylene chloride of polystyrene | 5 ml |

The coating of said solution proceeded in the same way as described in Example 1 on the same support.

The exposure to ultra-violet radiation yielded a same result as described in Example 1.

The electron beam exposure was effected with an electron beam having an accelerating potential of 20 kV and striking the recording target with a charge of $1.5 \times 10^{-4}$ C/sq.cm (Coulomb per sq.cm).

The coloured marks produced on the recording layer had an optical density measured behind green filter (transmission in the 500 to 600 nm wavelength range) of 0.4.

Analogous results were obtained by using spiropyran compound number 4 of Table 1 instead of spiropyran compound number 1 and by applying the electron beam-sensitive compound number 6 instead of number 2 of Table 4.

EXAMPLE 5

Example 4 was repeated with the difference, however, that instead of the electron beam-sensitive compound number 6 of Table 4, compound number 2 of Table 3 was used.

The coloured marks produced with the electron beam on the recording layer had an optical density measured behind red filter (transmission above 600 nm) of 1.1.

When the electron beam-sensitive compound number 2 of Table 3 was replaced by the electron beam-sensitive compound number 3 of Table 3, light-blue lines were obtained.

EXAMPLE 6

Example 4 was repeated with the difference, however, that instead of electron beam-sensitive compound 3 of Table 3, 100 mg of electron beam-sensitive compound 7 of Table 4 were used and the polystyrene was replaced by polymethyl methacrylate.

Brownish-black image marks were obtained by electron beam scanning.

EXAMPLE 7

Example 6 was repeated with the difference, however, that the spiropyran compound number 1 of Table 1 was replaced by the dye precursor compound number 18 of Table 2.

EXAMPLE 8

Example 4 was replaced with the proviso, however, that as electron beam-sensitive compound, compound number 8 of Table 4 was used and the polystyrene binding agent was replaced by poly-N-vinylcarbazole.

Analogous recording results have been obtained by using the electron beam-sensitive compound number 9 of Table 4.

The same composition containing, however, the dye precursor compound number 18 of Table 2 instead of the spiropyran compound number 1 of Table 1, gave analogous results.

EXAMPLE 9

A solution was prepared having the following composition:

| | |
|---|---|
| spiropyran compound number 1 of Table 1 as acid-producing compound : | 20 mg |
| 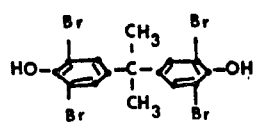 | 500 mg |
| methylene chloride | 5 ml |
| 10% solution of poly-N-vinylcarbazole in methylene chloride | 5 ml |

The coating of said solution was carried out as described in Example 1.

The electron beam exposure was effected with an electron beam having an accelerating potential of 20 kV striking the recording target with a charge of $1.5 \times 10^{-4}$ C/sq.cm.

The coloured marks produced in the recording layer had an optical density measured behind green filter (transmission in the 500 to 600 nm wavelength range) of 0.94.

Analogous results were obtained by replacing the poly-N-vinylcarbazole by polystyrene and the polyhalogenated phenol by the electron beam-sensitive compound number 9 of Table 4.

Analogous results were obtained by replacing the spiropyran compound number 1 of Table 1 by the dye precursor compound number 18 of Table 2.

EXAMPLE 10

A solution was prepared having the following composition:

| | |
|---|---|
| spiropyran compound number 1 of Table 1 as electron beam-sensitive compound : | 20 mg |
| 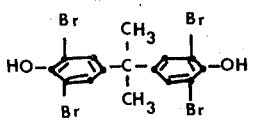 | 500 mg |
| methylene chloride | 5 ml |
| 10% polymethyl methacrylate solution in methylene chloride | 5 ml |
| a styryl dye having the following structural formula : | |
| 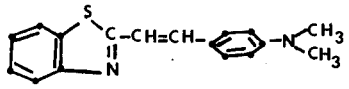 | 10 mg |

The coating of said solution was carried out as described in Example 1.

The electron beam exposure was effected with an electron beam having an accelerating potential of 20 kV striking the recording target with a charge of $5.4 \cdot 10^{-4}$ C/sq.cm.

The coloured marks produced in the recording layer had an optical density measured behind blue filter (transmission in the 400–500 nm wavelength range) of 0.54.

When leaving the styryl dye out of the recording layer composition an optical density of only 0.3 could be obtained.

EXAMPLE 11

A solution was prepared having the following composition:

| | |
|---|---|
| spiropyran compound number 4 of Table | 20 mg |
| Michler's ketone | 5 mg |
| copolymer of vinyl chloride and vinylidene chloride (50/50) | 100 mg |
| methylene chloride | 10 ml |

The solution was knife-coated (wet coating thickness 0.127 mm) on a support as described in Example 1.

The exposure to ultra-violet radiation carried out as described in Example 1 yielded an overall light blue colouration (spectral density: 0.2).

The electron beam exposure was the same as described in Example 4.

Blue coloured marks were obtained.

EXAMPLE 12

A solution was prepared having the following composition:

| | |
|---|---|
| dye precursor compound number 18 of Table 2 | 20 mg |
| electron beam-sensitive compound number 2 of Table 3 | 150 mg |
| 5 % solution of polystyrene | 10 ml |

The coating of said solution was carried out as described in Example 1.

The electron beam exposure was effected with an electron beam having an accelerating potential of 20 kV striking the recording target with a charge of $5.10^{-4}$ C/sq.cm.

The coloured marks produced in the recording layer had an optical density measured behind green filter (transmission in the 500–600 nm wavelength range) of 0.55.

By replacing the spiropyran compound number 4 by spiropyran compound number 1 and by using 500 mg of electron beam-sensitive compound number 3 of Table 3 in admixture to said composition the same electron beam recording result could be obtained with an accelerating potential of only 15 kV.

What is claimed is:

1. In a method of recording information by scanning an electron beam sensitive recording material with an electron beam modulated in intensity according to the information to be recorded, the improvement wherein said recording material comprises an electrically conductive substrate and superimposed thereon a layer comprising a mixture of:

1. at least one dye precursor compound of the group consisting of a sirodibenzopyran, a spirodinaphthopyran, a spirobenzonaphthopyran, a 1,3,3-trimethylindolinobenzospiropyran, a 1,3,3-trimethylindolino-naphthospiropyran, a spiropyran that contains a condensed aromatic nucleus of anthracene or phenanthrene, or a compound having one of the general formulae:

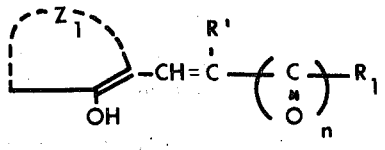

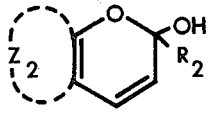

wherein:

$R_1$ represents an alkyl group, a phenyl group, a naphthyl group, or together with R′ the necessary atoms to close a cyclohexyl ring, R′ represents hydrogen, a $C_1$–$C_5$ alkyl group, a phenyl group or a phenoxy group, $Z_1$ represents the necessary atoms to close a phenyl or naphthyl nucleus, $Z_2$ represents the necessary atoms to close a benzene or naphthalene nucleus, $R_2$ represents a $C_1$–$C_5$ alkyl group, and

*n* represents 1 or 2, and 2. at least one member of the group consisting of an organic compound containing one or two halogen atoms linked to the same carbon atom that is further linked to at least one electron-withdrawing group, an organic compound that contains at least one non-halogen carrying carbon atom bound to at least one hydrogen atom and at least two electron-withdrawing groups, and a polyhalogenated aromatic hydroxy compound, said layer having a sufficiently low sensitivity to ultraviolet radiation that it exhibits an optical density not higher than 0.2 when exposed according to the standard test procedure described in the specification.

2. An electron beam recording method according to claim 1 wherein said mixture of compounds (1) and (2) are contained in a binder layer applied to said substrate.

3. An electron beam recording method according to claim 1 wherein said mixture of compounds (1) and (2) are contained in a binder layer applied to an electrically conductive interlayer, which is carried on an electrically insulating support.

4. An electron beam recording method according to claim 1 wherein said substrate has a surface resistance not lower than $1 \times 10^7$ Ω/sq.cm.

5. An electron beam recording method according to claim 3 wherein said support is a transparent resin support.

6. An electron beam recording method according to claim 1 wherein said compound (2) is an organic compound containing one or two halogen atoms linked to the same carbon atom that is further linked to at least one electron-withdrawing group of the class consisting of >C=O, $>SO_2$, -C ≡ N, $-NO_2$, $-N_3$ and phenyl.

7. An electron beam recording method according to claim 1 wherein said compound (2) is an organic compound containing at least one non-halogen-carrying carbon atom linked to at least one hydrogen atom and at least two electron-withdrawing groups of the class consisting of >C=O, $>SO_2$, -C ≡ N, $-N_3$ and -O-CO-R in which R is an organic group.

8. An electron beam recording method according to claim 1 wherein the amount of dye precursor compound per sq.m is in the range of 0.25 to 2 g.

9. An electron beam recording method according to claim 1 wherein said compound (2) is used with respect to the dye precursor compound in a molar ratio of 2:1 to 20:1.

10. An electron beam recording method according to claim 1 wherein said precursor is a spiropyran having one of the general formulae:

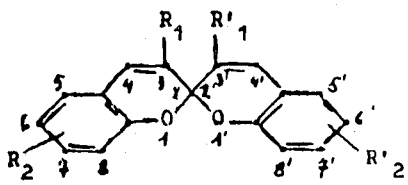

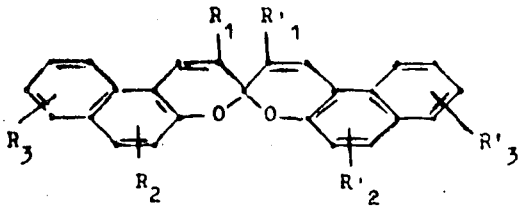

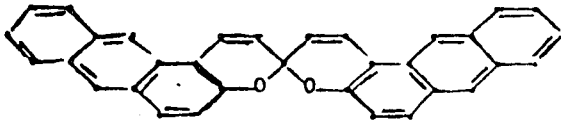

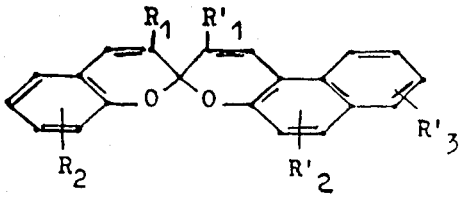

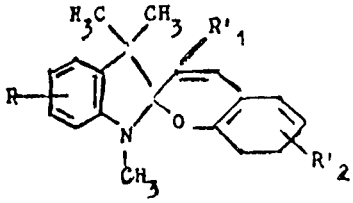

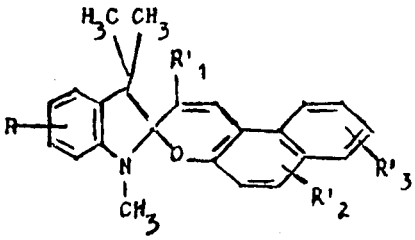

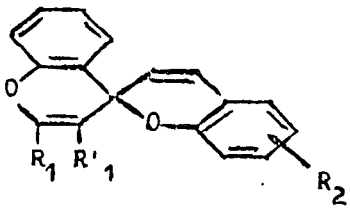

wherein:

R, $R_1$, $R'_1$, $R_2$, $R'_2$, $R_3$ and $R'_3$ each represent hydrogen, alkyl, alkyl substituted with halogen, alkyl substituted with an ester group, alkyl substituted with a carboxyl group, alkyl substituted with a N-phenylcarbamyl group, a hydroxy group, an alkoxy group, an aryloxy group, a phenyl group, piperidyl, acetyl, halogen, nitro, or $R_1$ and $R'_1$ together represent a $-(CH_2)_n-$ chain wherein n = 2 or 3 to link the carbon atoms in the 3 and 3′ positions together.

* * * * *